US007564413B2

(12) United States Patent
Kim et al.

(10) Patent No.: US 7,564,413 B2
(45) Date of Patent: Jul. 21, 2009

(54) MULTI-BAND ANTENNA AND MOBILE COMMUNICATION TERMINAL HAVING THE SAME

(75) Inventors: Hyun Hak Kim, Gyunggi-Do (KR); Jong Kweon Park, Daejeon (KR); Jung Nam Lee, Daejeon (KR); Jae Chan Lee, Gyunggi-Do (KR)

(73) Assignee: Samsung Electro-Mechanics Co., Ltd., Suwon, Kyungki-Do (KR)

( * ) Notice: Subject to any disclaimer, the term of this patent is extended or adjusted under 35 U.S.C. 154(b) by 2 days.

(21) Appl. No.: 12/026,373

(22) Filed: Feb. 5, 2008

(65) Prior Publication Data

US 2008/0204340 A1 Aug. 28, 2008

(30) Foreign Application Priority Data

Feb. 28, 2007 (KR) ..... 10-2007-0020302

(51) Int. Cl.
*H01Q 1/24* (2006.01)

(52) U.S. Cl. ..... 343/702; 343/700 MS

(58) Field of Classification Search ..... 343/702, 343/770, 767, 700 MS, 846
See application file for complete search history.

(56) References Cited

U.S. PATENT DOCUMENTS 6,903,690 B2 * 6/2005 Leclerc et al. ..... 343/700 MS
7,113,133 B2 * 9/2006 Chen et al. ..... 343/700 MS
7,466,277 B2 * 12/2008 Ishizuka et al. ..... 343/702
2006/0145924 A1 7/2006 Chen et al.

OTHER PUBLICATIONS

Korean Intellectual Property Office, Office Action mailed Apr. 22, 2008.

* cited by examiner

*Primary Examiner*—James Cho
(74) *Attorney, Agent, or Firm*—Lowe Hauptman Ham & Berner

(57) ABSTRACT

There is provided a mobile communication terminal including: a dielectric substrate; a ground surface formed on a first area of the dielectric substrate; a radiation part disposed on a second area where the ground surface is not formed, at a predetermined distance from the dielectric substrate, the radiation part having first and second slots formed thereon; a feeding line formed on the second area of the dielectric substrate and having one end connected to the radiation part; a ground line disposed on the second area of the dielectric substrate at a predetermined distance from the feeding line and having one end connected to the radiation part and another end connected to the ground surface; and a matching ground surface formed on the second area of the dielectric substrate, the matching ground surface disposed in a superimposed relationship with a portion of the radiation part and extending from the ground surface to be capacitively coupled to the radiation part.

11 Claims, 8 Drawing Sheets

MULTI-BAND ANTENNA AND MOBILE COMMUNICATION TERMINAL HAVING THE SAME

CROSS-REFERENCE TO RELATED APPLICATIONS

This application claims the priority of Korean Patent Application No. 2007-20302 filed on Feb. 28, 2007, in the Korean Intellectual Property Office, the disclosure of which is incorporated herein by reference.

BACKGROUND OF THE INVENTION

1. Field of the Invention

The present invention relates to a multi-band antenna and a mobile communication terminal having the same, and more particularly, to an antenna in which a plurality of slots are formed to ensure multi-band characteristics and a mobile communication terminal in which a matching ground surface is formed to be capacitively coupled to the antenna to achieve broadband characteristics.

2. Description of the Related Art

Drastic development in mobile telecommunication technology has reduced size of and diversified functions of mobile communication devices. In line with the compact trend of portable terminals, internal antennas have been introduced. Also, with diversified mobile services, efforts are underway to develop an antenna covering various frequency bands which are currently available.

The internal antenna is installed inside a terminal, thereby entailing several problems. That is, the small internal antenna mounted inside the terminal experiences decrease in gain, and its proximity to internal devices affects antenna characteristics due to the surrounding metal materials. Moreover, mobile phones with diverse functions may be altered in antenna characteristics by cameras, liquid crystal panels (LCDs) and batteries. Therefore, the antenna needs to have high gain and broadband frequency so as not to be changed in characteristics despite effects from the surrounding devices.

FIG. 1 is a perspective view illustrating a conventional planar inverted F-type antenna (PIFA).

Referring to FIG. 1, a radiator 101 is disposed on a ground surface 100 and a short-circuit plate 102 is bent perpendicularly from an edge of the radiator 101 to be in contact with the ground surface 100. A feeding point 103 is located to allow for impedance matching of the antenna.

The planar inverted F-type antenna is construed to be a kind of a short-circuit microstrip antenna, in which the short-circuit plate 102 is formed between the ground surface 100 having an electric field of zero and the radiator 101 so that the radiator 101 is halved in length. Here, the radiator 101 having a width smaller than a width of the short-circuit plate 102 increases effective inductance of the antenna device, and reduces a resonant frequency over a general short-circuit microstrip antenna having a radiator with an identical length. This allows the short-circuit microstrip antenna to be further reduced in length while maintaining the PIFA structure.

The conventional PIFA exhibits dual band characteristics but is configured to have an edge bent, thereby degraded in gain and efficiency.

SUMMARY OF THE INVENTION

An aspect of the present invention provides a compact mobile communication antenna increased in gain and efficiency while maintaining broadband and multi-band characteristics.

According to an aspect of the present invention, there is provided a mobile communication terminal including: a dielectric substrate; a ground surface formed on a first area of the dielectric substrate; a radiation part disposed on a second area where the ground surface is not formed, at a predetermined distance from the dielectric substrate, the radiation part having first and second slots formed thereon; a feeding line formed on the second area of the dielectric substrate and having one end connected to the radiation part; a ground line disposed on the second area of the dielectric substrate at a predetermined distance from the feeding line and having one end connected to the radiation part and another end connected to the ground surface; and a matching ground surface formed on the second area of the dielectric substrate, the matching ground surface disposed in a superimposed relationship with a portion of the radiation part and extending from the ground surface to be capacitively coupled to the radiation part.

The mobile communication terminal may further include a non-conductive fixer having a predetermined height such that the radiation part is disposed at a distance from the dielectric substrate.

The first slot may be formed such that the radiation part demonstrates frequency characteristics in a 880 to 960 MHz global system for mobile communication band, a 1.575 GHz global positioning system band, a 1.71 to 1.88 GHz digital communication system band, and a 1.85 to 1.99 GHz personal communications service band, and the second slot is formed such that the radiation part demonstrates frequency characteristics in a 2.4 GHz instrumentation scientific and medical band.

The radiation part may include: a primary radiator; and at least one secondary radiator bent perpendicularly from an edge of the primary radiator. Here, the primary radiator is of a rectangular shape, and the at least one secondary radiator may include: a first secondary radiator connected to one side of the primary radiator; and a second secondary radiator connected to another side of the primary radiator adjacent to the one side.

The first slot may include: a first slot segment formed along a boundary between the primary radiator and the first secondary radiator and having one open end; a second slot segment having one end connected perpendicular to another end of the first slot segment; a third slot segment extending from another end of the second slot segment perpendicular to the second slot segment, in opposing directions; a fourth slot segment extending perpendicularly from one end of the third slot segment; and a fifth slot segment extending perpendicularly from another end of the third slot segment to the second secondary radiator.

The second slot may include: a first slot segment having one end opened to still another side of the primary radiator; a second slot segment having one end connected to another end of the first slot segment; a third slot segment having one end connected to another end of the second slot segment; a fourth slot segment extended from another end of the second slot segment to the second secondary radiator to be perpendicular to the third slot segment, wherein the first slot segment has a width greater than a width of the other slot segments.

The feeding line and the ground line may be formed of a micro-strip line, respectively. Each of the feeding line and ground line may be provided at one end with a contact terminal having a predetermined height to be connected to the radiation part.

According to another aspect of the present invention, there is provided a multi-band antenna including: a primary radiator of a rectangular shape; a first secondary radiator bent perpendicularly from one side of the primary radiator; a second secondary radiator bent perpendicularly from another side of the primary radiator adjacent to the one side; a first slot including: a first slot segment formed along a boundary between the primary radiator and the first secondary radiator and having one open end; a second slot segment having one end connected perpendicular to another end of the first slot segment; a third slot segment extending from another end of the second slot segment perpendicular to the second slot segment, in opposing directions; a fourth slot segment extending perpendicularly from one end of the third slot segment; and a fifth slot segment extending perpendicularly from another end of the third slot segment to the second secondary radiator; and a second slot including: a first slot segment having one end opened to still another side of the primary radiator; a second slot segment having one end connected to another end of the first slot segment; a third slot segment having one end connected to another end of the slot segment; a fourth slot segment extended from another end of the second slot segment to the second secondary radiator to be perpendicular to the third slot segment.

The first slot may be formed such that the antenna demonstrates frequency characteristics in a 880 to 960 MHz global system for mobile communication band, a 1.575 GHz global positioning system band, a 1.71 to 1.88 GHz digital communication system band, and a 1.85 to 1.99 GHz personal communications service band, and the second slot may be formed such that the antenna demonstrates frequency characteristics in a 2.4 GHz instrumentation scientific and medical band.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1:
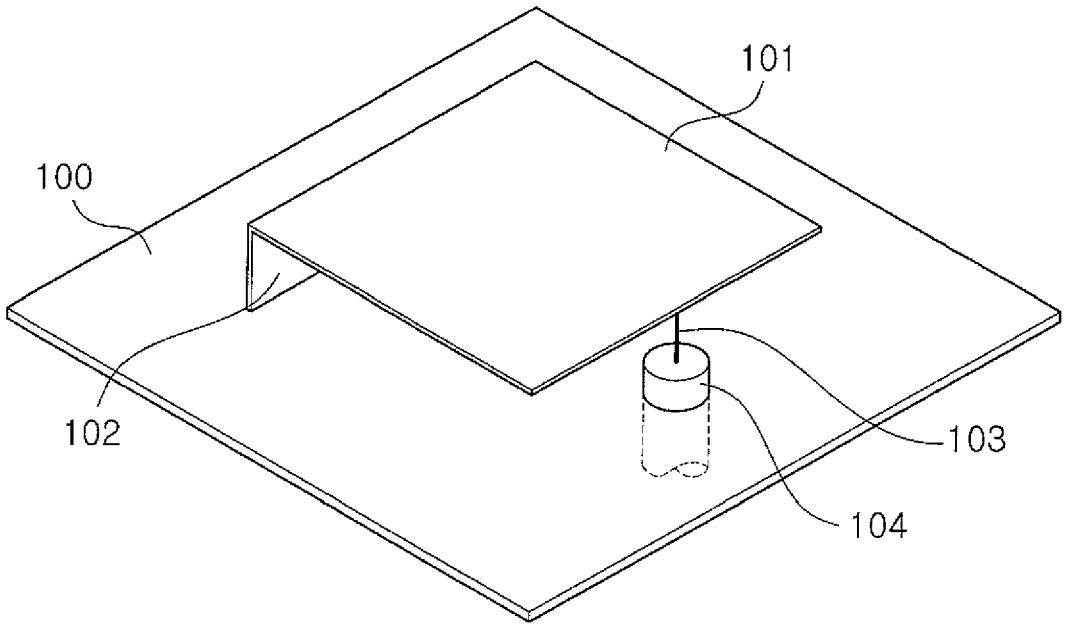
PRIOR ART FIG. 1
FIG. 1 is a perspective view illustrating a conventional planar inverted F antenna.
Figure 2:
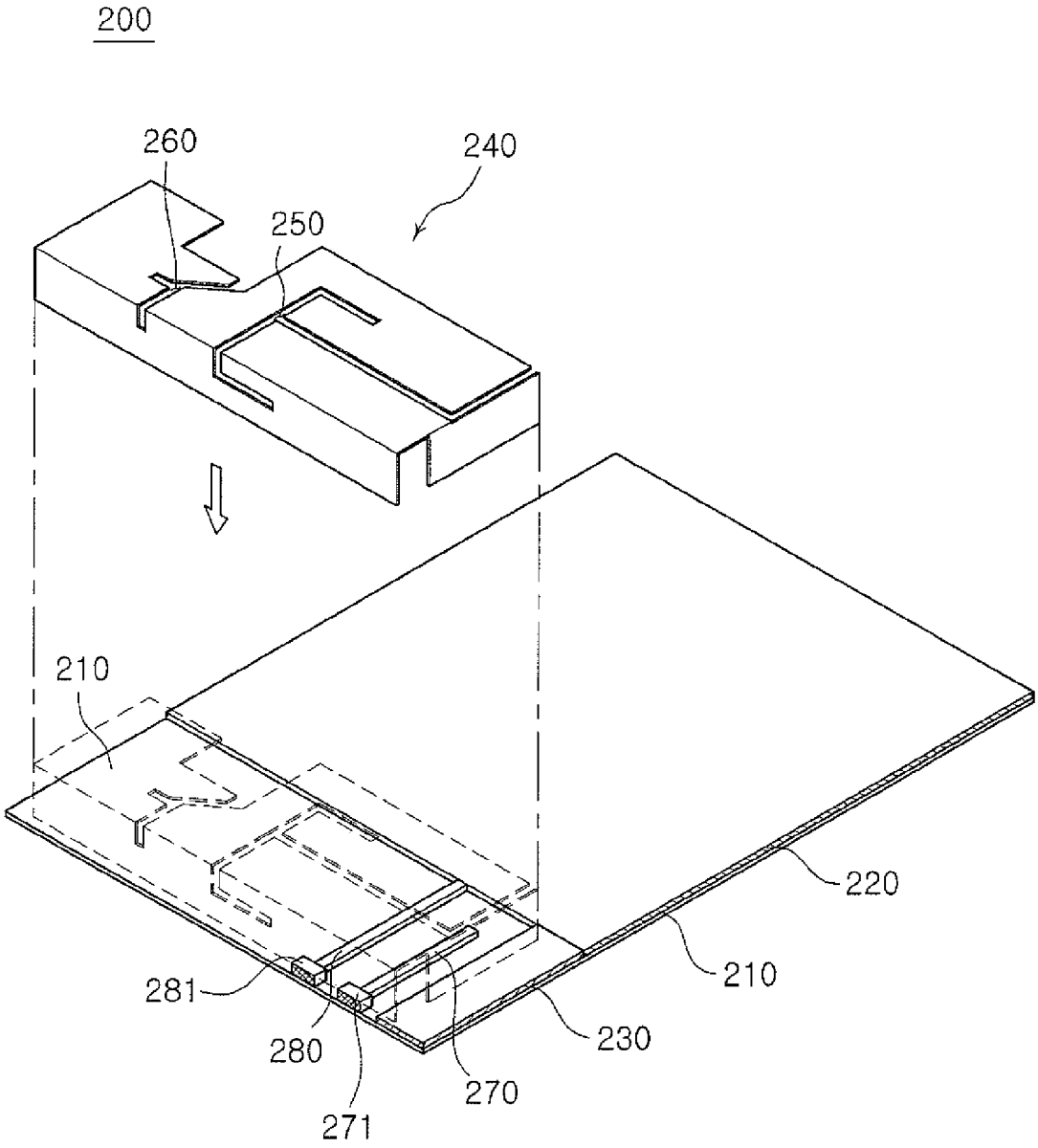
FIG. 2 is an exploded perspective view illustrating a substrate and a radiation part employed in a mobile communication terminal according to an exemplary embodiment of the invention.

FIG. 2 is an exploded perspective view illustrating a substrate and a radiation part employed in a mobile communication terminal according to an exemplary embodiment of the invention.

Referring to FIG. 2, the mobile communication terminal 200 of the present embodiment includes a dielectric substrate 210 and a radiation part 240.

The dielectric substrate 210 may be formed of a material having a predetermined permittivity. For example, the dielectric substrate 210 may utilize ceramic and FR-4.

A ground surface 220 is formed on one area of the dielectric substrate 210. The ground surface 220 serves as a shield when other passive and active devices (not shown) necessary for the mobile communication terminal are mounted on the dielectric substrate.

The radiation part 240 is disposed on another area of the dielectric substrate where the ground surface 220 is not formed.

The radiation part 240 is disposed at a predetermined distance from the dielectric substrate 210.

A first slot 250 and a second slot 260 are formed on the radiation part 240 to realize multi-band characteristics.

A feeding line 270 and a ground line 280 are formed on the dielectric substrate 210 to each have one end connected to the radiation part 240.

The feeding line 270 has the one end 271 in contact with the radiation part 240 and another end opened to be connected to an external feeder.

The ground line 280 has the one end 281 in contact with the radiation part 240 and another end in contact with the ground surface 220.

The feeding line 270 and the ground line 280 are printed on the dielectric substrate 210 in a micro-strip line. Here, the feeding line 270 and the ground line 280 each may be designed to have a resistance of 50Ω.

The respective one ends 271 and 281 of the feeding line 270 and the ground line 280 are brought in contact with the radiation part 240. In the present embodiment, the radiation part is disposed not to be in direct contact with the dielectric substrate, and thus the respective one ends 271 and 281 of the feeding line and ground line may be formed at a predetermined height.

The feeding line 270 and the ground line 280 are spaced apart from each other at a predetermined distance.

A distance between the feeding line 270 and the ground line 280 may be varied to adjust frequency characteristics. In the present embodiment, a 880 MHz to 960 MHz global system for mobile communication (GSM) band can be adjusted in frequency characteristics by varying the distance between the feeding line 270 and the ground line 280.

A matching ground surface 230 is formed on an area of the dielectric substrate 210 where the ground surface 220 is not formed. The matching ground surface 230 is disposed in a superimposed relationship with a portion of the radiation part to be capacitively coupled to the radiation part 240. The matching ground surface 230 is extended from the ground surface 220.

The matching ground surface 230 does not come in direct contact with the radiation part 240 but serves to adjust impedance through the radiator capacitively coupled thereto. This capacitive coupling has a magnitude adjusted by a distance between the matching ground surface 230 and radiation part 240 and a superimposed area thereof. Therefore, the matching ground surface 230 can be adjusted in size to achieve broadband characteristics of the antenna.

The matching ground surface 230 may have a portion in a superimposed relationship with a portion of the radiation part 240 and may be formed of a material identical to the ground surface 220.

Figure 3:
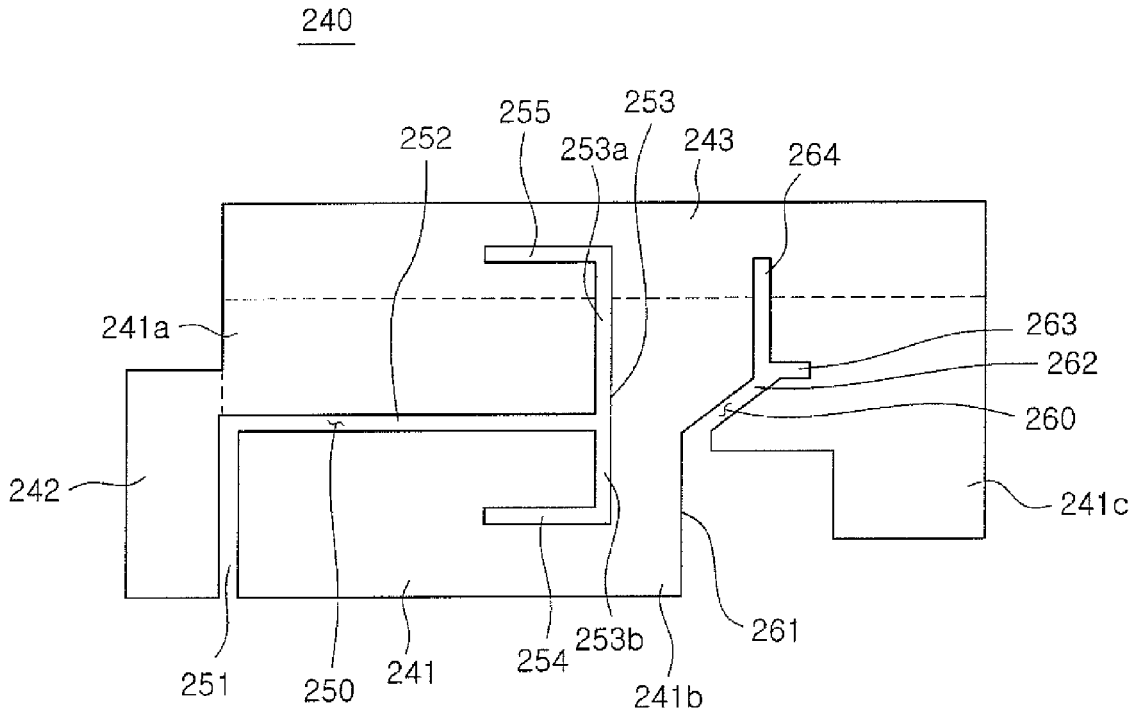
FIG. 3 is a development view illustrating a radiation part employed in a mobile communication terminal according to an exemplary embodiment of the invention.

FIG. 3 is a development view illustrating a radiation part employed in a mobile communication terminal according to an exemplary embodiment of the invention.

Referring to FIG. 3, the radiation part 240 of the present embodiment includes a primary radiator 241, a first secondary radiator 242, and a second secondary radiator 243.

In the present embodiment, the primary radiator 241 is of a rectangular shape. The first secondary radiator 242 is extended perpendicularly from one side of the primary radiator and the second secondary radiator 243 is extended perpendicularly from another side of the primary radiator 241.

As described above, the radiation part has an edge bent perpendicularly to realize a smaller-sized antenna.

A first slot 250 and a second slot 260 are formed on the radiation part.

The first slot 250 and the second slot 260 define the primary radiator 241 into three areas 241*a*, 241*b*, and 241*c* thereby to allow for multi-band frequency characteristics.

The first slot 250 includes first to fifth slot segments 251 to 255. The first slot segment 251 is formed along a boundary between the primary radiator 241 and the first secondary radiator 242 and has one open end. The second slot segment 252 has one end connected perpendicular to another end of the first slot segment 251. The third slot segment 253 extends from another end of the second slot segment 252 perpendicular to the second slot segment, in opposing directions. The fourth slot segment 254 extends perpendicularly from one end of the third slot segment 253. The fifth slot segment 255 extends perpendicularly from another end of the third slot segment 253.

The third slot segment 253 may be divided into two areas 253*a* and 253*b*, and one 253*a* of the areas may be extended to the second secondary radiator 243.

In the present embodiment, a portion of the first slot 250 including the first slot segment 251, the second slot segment 252, the third slot segment 253*a*, and the fifth slot segment 255 defines a current path in the radiation part to achieve characteristics satisfying the GSM frequency band.

Moreover, a portion of the first slot 250 including the third slot segment 253 and the fourth slot segment 254 defines another current path in the radiation part to attain characteristics satisfying global positioning system (GPS), digital communication system (DCS), and personal communications service (PCS) frequency bands.

The second slot 260 includes first to fourth slot segments 261 to 264. The first slot segment 261 has one end opened to still another side of the primary radiator 241. The second slot segment 262 has one end connected to another end of the first slot segment 261. The third slot segment 263 has one end connected to another end of the second slot segment 262. A fourth slot segment 264 is extended from another end of the second slot segment 262 to the second secondary radiator 243, perpendicular to the third slot segment 263.

The first slot segment 261 of the second slot 260 may have a width greater than a width of the other slot segments.

In the present embodiment, the second lot 260 including the first to fourth segments 261, 262, 263, and 264 defines yet another current path in the radiation part to realize characteristics satisfying an instrumentation scientific and medical (ISM) frequency band.

The first slot and the second slot may be varied in length to adjust resonance characteristics of the antenna. Variation in length of the slots leads to change in the current path formed inside the radiation part.

Figure 4:
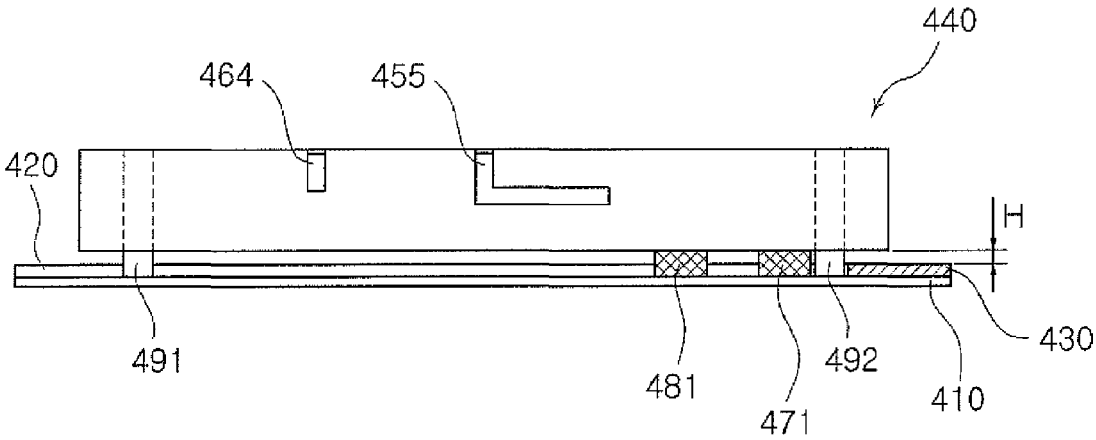
FIG. 4 is a rear view illustrating a substrate and a radiation part employed in a mobile communication terminal according to an exemplary embodiment of the invention.

FIG. 4 is a rear view illustrating a substrate and a radiation part employed in a mobile communication terminal according to an exemplary embodiment of the invention.

Referring to FIG. 4, the mobile communication terminal of the present embodiment includes a dielectric substrate 410, a radiation part 440, a matching ground surface 430, and fixers 491 and 492.

The fixers 491 and 492 allow the radiation part 440 to be supportably spaced apart from the dielectric substrate 410 at a predetermined distance H. The fixers 491 and 492 may be formed of not a conductive material but a dielectric material. The fixers 491 and 492 may be formed of plastic, ceramic and the like.

The fixers 491 and 492 enable the radiation part 440 to be spaced apart at a predetermined distance H from the matching ground surface 430 formed on the dielectric substrate 410. The distance between the radiation part 440 and the matching ground surface 430 leads to variance in magnitude of capacitive coupling. Thus, the fixers 491 and 492 can be varied in height to adjust the antenna characteristics.

To increase the distance H between the radiation part 440 and the matching ground surface 430, the fixers 491 and 492 may be formed with a greater height or a secondary radiator of the radiation part may be formed with a smaller width. However, the radiation part 440 should at least contact a feeding line terminal and a ground line terminal 481 formed on the dielectric substrate. To increase the height of the feeding line terminal 471 and the ground line terminal 481, respectively may be accompanied with procedural limitations. Thus, portions of the radiation part 440 corresponding to the feeding line terminal and ground line terminal 471 and 472 may be led out.

Figure 5:
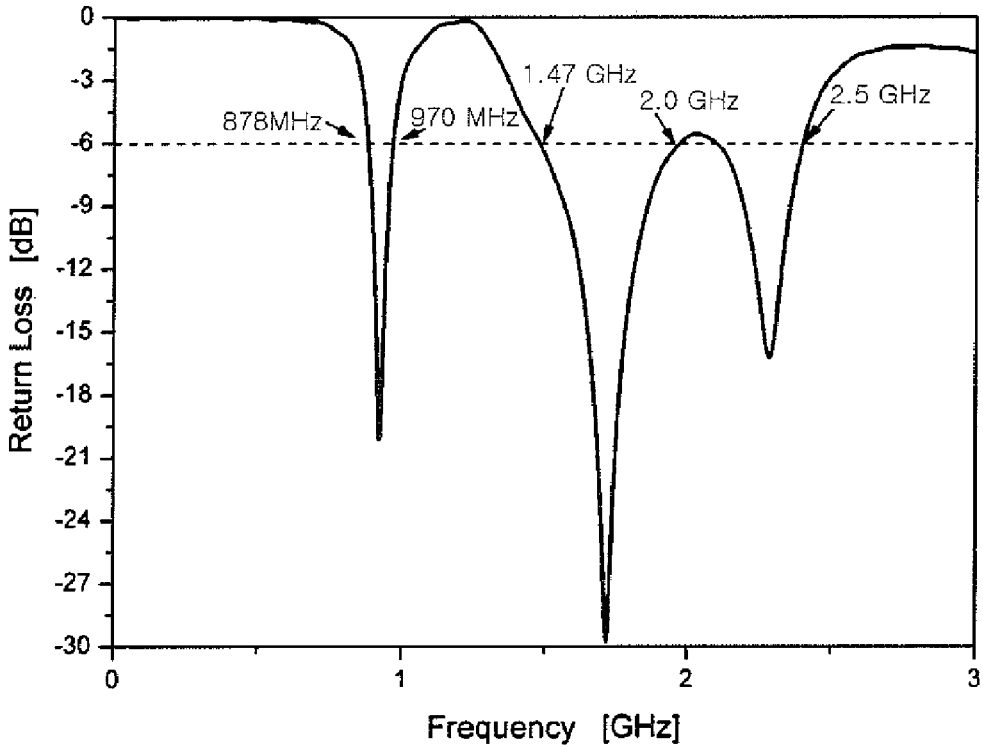
FIG. 5 is a graph illustrating return loss with respect to frequency in a mobile communication terminal according to an exemplary embodiment of the invention.

FIG. 5 is a graph illustrating return loss with respect to frequency in a mobile communication terminal according to an exemplary embodiment of the invention.

In FIG. 5, a dielectric substrate and a radiation part for use in the mobile communication terminal according to the embodiment shown in FIG. 2 are employed. Here, the dielectric substrate is an FR-4 dielectric substrate with a size of 40 mm×90 mm×0.4 mm and a permittivity of 4.5, and the radiation part (primary radiator) has a size of 36 mm×20 mm.

Referring to FIG. 5, the mobile communication terminal has a frequency of 878 MHz to 970 MHz, 1.47 GHz to 2.0 GHz, and 2.2 GHz to 2.5 GHz at −6 dB or less, where VSWR=3:1. Therefore, the mobile communication terminal can operate in frequency bands of GSM (880 to 960 MHz), GPS (1.575 GHz), DCS (1.71 to 1.88 GHz), PCS (1.85 to 1.99 GHz), and ISM (2.4 GHz).

Figure 6:
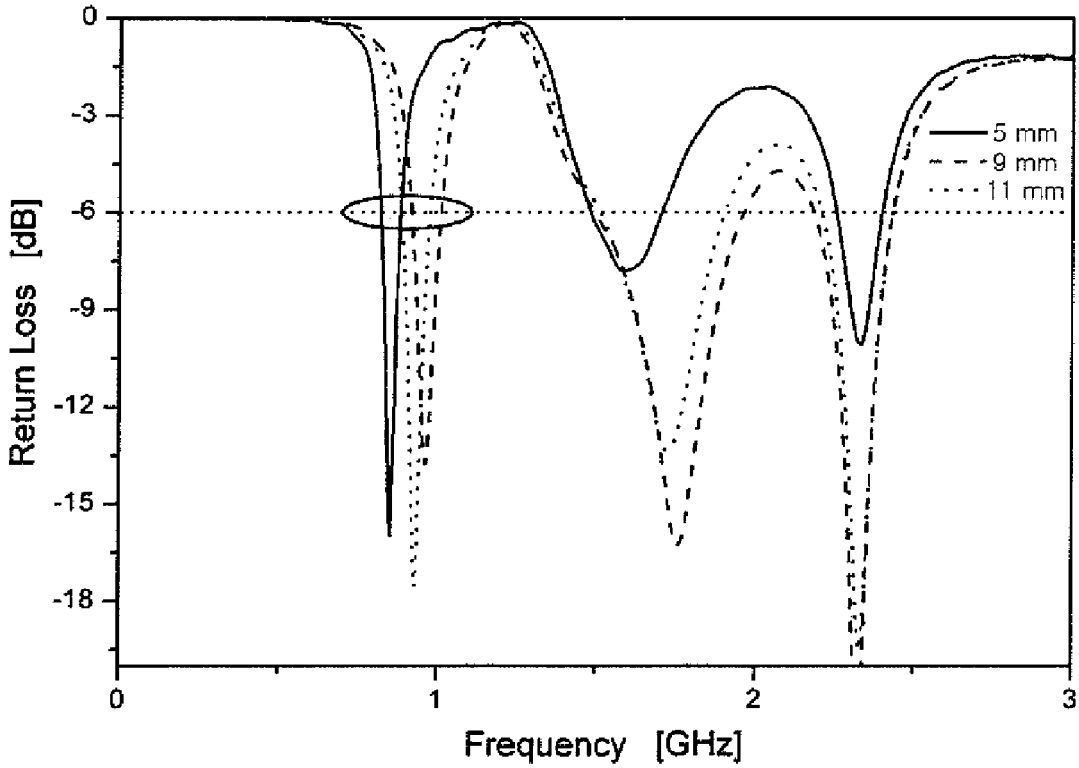
FIG. 6 is a graph illustrating return loss plotted with a change in a distance between a feeding line and a ground line.

FIG. 6 is a graph illustrating return loss plotted with a change in a distance between a feeding line and a ground line.

Referring to FIG. 6, in a case where the feeding line and the ground line are spaced apart from each other at a distance of 5 mm, the mobile communication terminal has a low resonant frequency at a GSM (880 to 960 MHz) band as indicated in the left portion. On the other hand, in a case where the freeing line and the ground line are spaced apart from each other at a distance of 9 mm, the mobile communication terminal has a high resonant frequency as indicated in the right portion. In a case where the distance between the feeding line and the ground line is 11 mm, the mobile communication terminal has a resonant frequency ranging between a resonant frequency plotted when the distance is 5 mm and a resonant frequency plotted when the distance is 9 mm, at the GSM band.

Therefore, the distance between the feeding line and the ground line can be varied to adjust a resonant frequency at the GSM (880 to 960 MHz) band.

Figure 7:
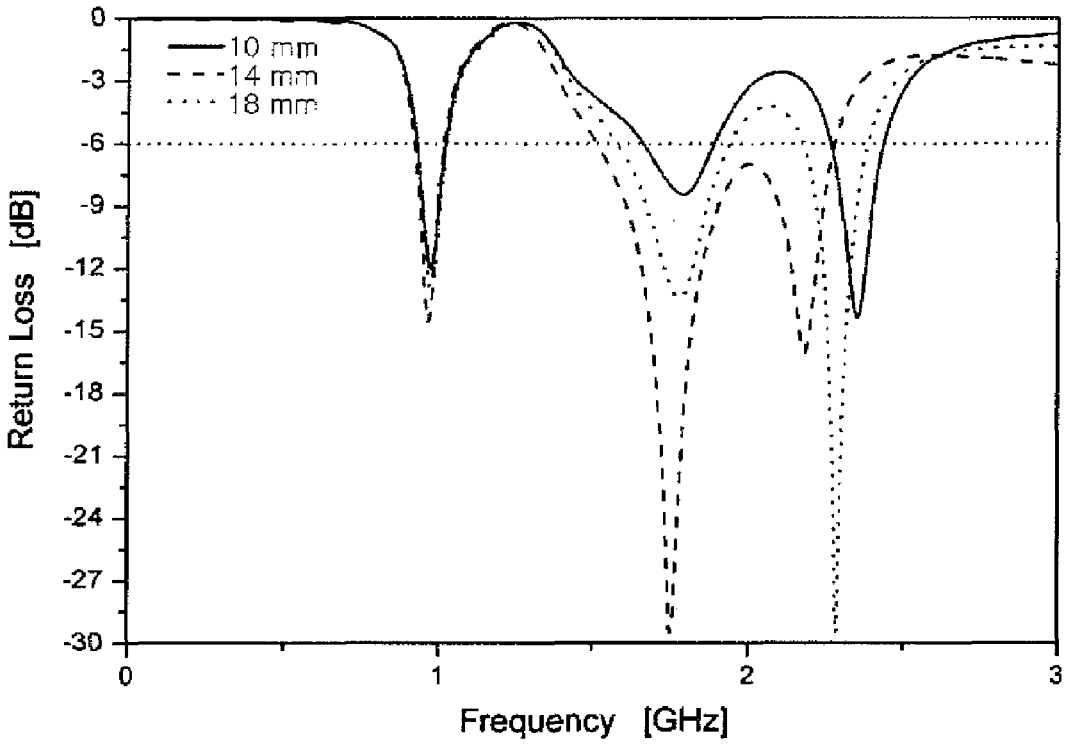
FIG. 7 is graph illustrating a change in frequency characteristics in accordance with a change in size of a matching ground surface in a mobile communication terminal according to an exemplary embodiment of the invention.

FIG. 7 is graph illustrating frequency characteristics in accordance with a change in size of a matching ground surface in a mobile communication terminal according to an exemplary embodiment of the invention. In the present embodiment, the matching ground surface has a length maintained constant and a width varied.

Referring to FIG. 7, in a case where the matching ground surface is 14 mm in width, the mobile communication terminal exhibits a wider bandwidth than in a case where the matching ground surface is 10 mm in width. However, the mobile communication terminal demonstrates a narrower bandwidth in a case where the matching ground surface is 18 mm in width.

Therefore, broadband characteristics can be achieved by varying the width of the matching ground surface.

Figure 8A:
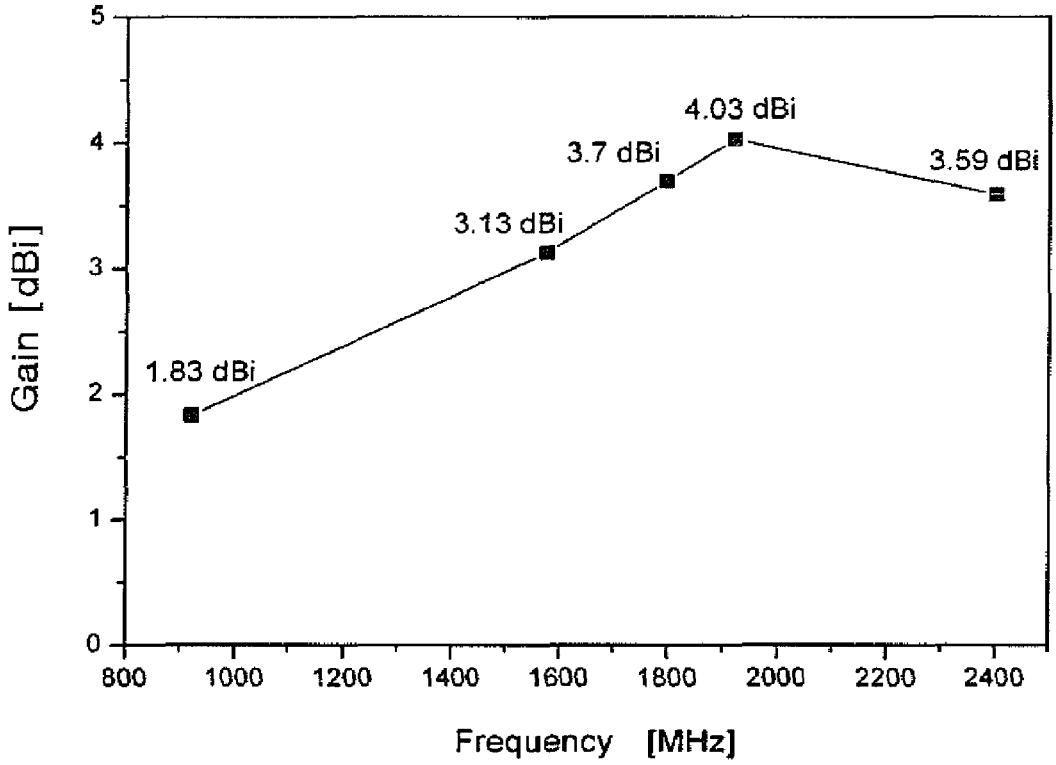
FIGS. 8A and 8B are graphs illustrating gain and radiation efficiency of an antenna in a mobile communication terminal, respectively according to an exemplary embodiment of the invention.
Figure 8B:
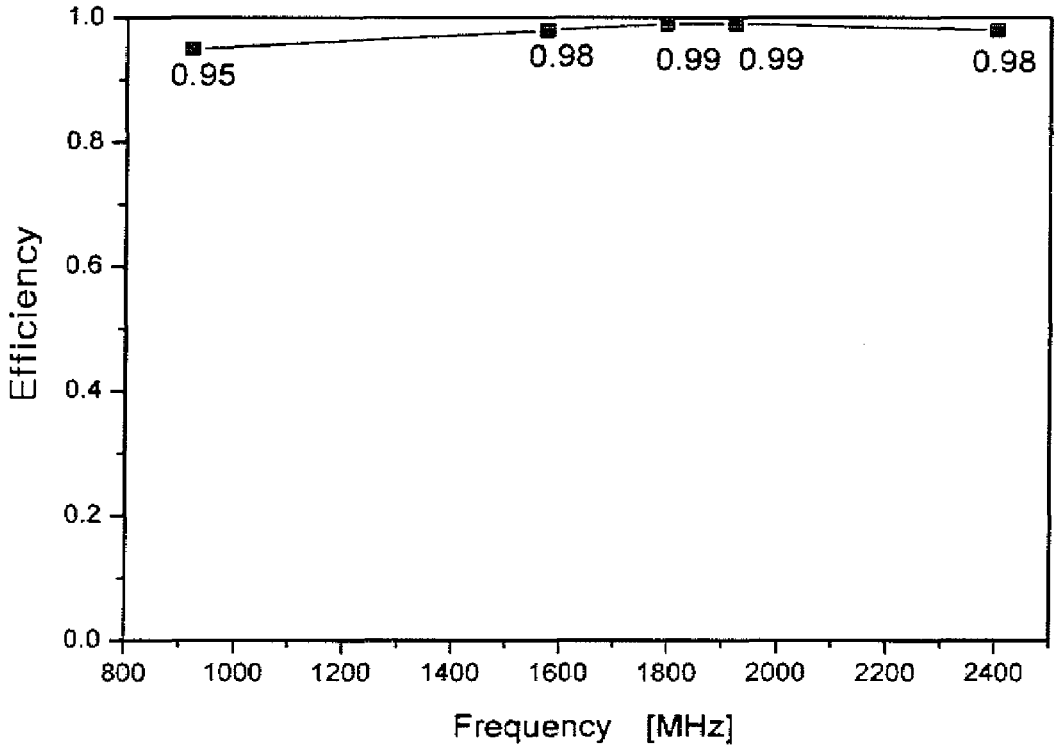

FIGS. 8A and 8B are graphs illustrating gain and radiation efficiency of an antenna in a mobile communication terminal according to an exemplary embodiment of the invention.

Referring to FIGS. 8A and 8B, in the present embodiment, a gain of 1.83 [dBi] and an efficiency of 0.95 are plotted at a GSM (880 to 960 MHz) band, a gain of 3.13 [dBi) and an efficiency of 0.98 are plotted at a GPS (1.575 GHz) band, a gain of 3.7 [dBi] and an efficiency of 0.99 are plotted at a DCS (1.71 to 1.88 GHz) band, a gain of 4.03 [dBi] and an efficiency of 0.99 are plotted at a PCS (1.85 to 1.99 GHz) band, and a gain of 3.59 [dBi] and an efficiency of 0.98 are plotted at an ISM (2.4 GHz) band.

As set forth above, according to exemplary embodiments of the invention, an antenna attains multi-band characteristics by virtue of a plurality of slots and a mobile communication terminal realizes broadband characteristics by a matching ground surface capacitively coupled to the antenna.

While the present invention has been shown and described in connection with the exemplary embodiments, it will be apparent to those skilled in the art that modifications and variations can be made without departing from the spirit and scope of the invention as defined by the appended claims.

What is claimed is:

1. A mobile communication terminal comprising:

a dielectric substrate;

a ground surface formed on a first area of the dielectric substrate;

a radiation part disposed on a second area of the dielectric substrate where the ground surface is not formed, at a predetermined distance from the dielectric substrate, the radiation part having first and second slots formed thereon;

a feeding line formed on the second area of the dielectric substrate and having one end connected to the radiation part;

a ground line disposed on the second area of the dielectric substrate at a predetermined distance from the feeding line and having one end connected to the radiation part and another end connected to the ground surface; and a matching ground surface formed on the second area of the dielectric substrate, the matching ground surface disposed in a superimposed relationship with a portion of the radiation part and extending from the ground surface to be capacitively coupled to the radiation part.

2. The mobile communication terminal of claim 1, further comprising a non-conductive fixer having a predetermined height such that the radiation part is disposed at a distance from the dielectric substrate.

3. The mobile communication terminal of claim 1, wherein the first slot is formed such that the radiation part demonstrates frequency characteristics in a 880 to 960 MHz global system for mobile communication band, a 1.575 GHz global positioning system band, a 1.71 to 1.88 GHz digital communication system band, and a 1.85 to 1.99 GHz personal communications service band, and the second slot is formed such that the radiation part demonstrates frequency characteristics in a 2.4 GHz instrumentation scientific and medical band.

4. The mobile communication terminal of claim 1, wherein the radiation part comprises:

a primary radiator; and at least one secondary radiator bent perpendicularly from an edge of the primary radiator.

5. The mobile communication terminal of claim 4, wherein the primary radiator is of a rectangular shape, and the at least one secondary radiator comprises:

a first secondary radiator connected to one side of the primary radiator; and a second secondary radiator connected to another side of the primary radiator adjacent to the one side.

6. The mobile communication terminal of claim 5, wherein the first slot comprises:

a first slot segment formed along a boundary between the primary radiator and the first secondary radiator and having one open end;

a second slot segment having one end connected perpendicular to another end of the first slot segment;

a third slot segment extending from another end of the second slot segment perpendicular to the second slot segment, in opposing directions;

a fourth slot segment extending perpendicularly from one end of the third slot segment; and a fifth slot segment extending perpendicularly from another end of the third slot segment to the second secondary radiator.

7. The mobile communication terminal of claim 5, wherein the second slot comprises:

a first slot segment having one end opened to still another side of the primary radiator;

a second slot segment having one end connected to another end of the first slot segment;

a third slot segment having one end connected to another end of the second slot segment;

a fourth slot segment extended from another end of the second slot segment to the second secondary radiator to be perpendicular to the third slot segment, wherein the first slot segment has a width greater than a width of the other slot segments.

8. The mobile communication terminal of claim 1, wherein the feeding line and the ground line are formed of a microstrip line, respectively.

9. The mobile communication terminal of claim 8, wherein each of the feeding line and ground line is provided at one end with a contact terminal having a predetermined height to be connected to the radiation part.

10. A multi-band antenna comprising:

a primary radiator of a rectangular shape;

a first secondary radiator bent perpendicularly from one side of the primary radiator;

a second secondary radiator bent perpendicularly from another side of the primary radiator adjacent to the one side;

a first slot comprising:

a first slot segment formed along a boundary between the primary radiator and the first secondary radiator and having one open end;

a second slot segment having one end connected perpendicular to another end of the first slot segment;

a third slot segment extending from another end of the second slot segment perpendicular to the second slot segment, in opposing directions;

a fourth slot segment extending perpendicularly from one end of the third slot segment; and a fifth slot segment extending perpendicularly from another end of the third slot segment to the second secondary radiator; and a second slot comprising:

a first slot segment having one end opened to still another side of the primary radiator;

a second slot segment having one end connected to another end of the first slot segment of the second slot;

a third slot segment having one end connected to another end of the second slot segment of the second slot;

a fourth slot segment extended from the another end of the second slot segment of the second slot to the second secondary radiator to be perpendicular to the third slot segment of the second slot.

11. The multi-band antenna of claim 10, wherein the first slot is formed such that the antenna demonstrates frequency characteristics in a 880 to 960 MHz global system for mobile communication band, a 1.575 GHz global positioning system band, a 1.71 to 1.88 GHz digital communication system band, and a 1.85 to 1.99 GHz personal communications service band, and the second slot is formed such that the antenna demonstrates frequency characteristics in a 2.4 GHz instrumentation scientific and medical band.

* * * * *